US005915301A

United States Patent [19]

Pollock

[11] Patent Number: 5,915,301

[45] Date of Patent: Jun. 29, 1999

[54] UPPER FOLDER DRIVE ROLL ARRANGEMENT

[75] Inventor: David Clarke Pollock, Somersworth, N.H.

[73] Assignee: Heidelberger Druckmaschinen AG, Heidelberg, Germany

[21] Appl. No.: 08/947,003

[22] Filed: Oct. 8, 1997

[51] Int. Cl.[6] ..... B41F 13/56

[52] U.S. Cl. ..... 101/227; 101/228; 493/416; 270/21.1

[58] Field of Search ..... 400/223; 101/216, 101/219, 224, 225, 226, 227, 228; 270/6, 8, 10, 20.1, 21.1; 493/357, 425, 416, 423, 458

[56] References Cited

U.S. PATENT DOCUMENTS

| | | | |
|---|---|---|---|
| 2,231,661 | 2/1941 | Cline | 101/219 |
| 3,280,737 | 10/1966 | Huck | 101/219 |
| 4,619,449 | 10/1986 | Fischer . | |
| 4,925,179 | 5/1990 | Breton et al. . | |
| 5,016,863 | 5/1991 | Birkmair . | |
| 5,048,810 | 9/1991 | Palmatier et al. | 270/10 |
| 5,180,160 | 1/1993 | Belanger et al. . | |
| 5,322,270 | 6/1994 | Belanger et al. . | |
| 5,458,062 | 10/1995 | Goldberg et al. | 101/226 |
| 5,485,992 | 1/1996 | Albert et al. . | |
| 5,535,996 | 7/1996 | Dancause | 270/6 |
| 5,788,226 | 8/1998 | Peglow | 270/41 |

FOREIGN PATENT DOCUMENTS

| | | |
|---|---|---|
| 2-43159 | 2/1990 | Japan . |
| 2 283 826 | 5/1995 | United Kingdom . |

*Primary Examiner*—Eugene Eickholt
*Attorney, Agent, or Firm*—Kenyon & Kenyon

[57] ABSTRACT

A device for feeding a plurality of ribbons to a processing unit includes a first driven roll receiving a first of the plurality of ribbons and a second driven roll receiving a second of the plurality of ribbons, the first driven roll and the second driven roll being arranged adjacent to the processing unit, the first and second driven rolls individually driving respective ribbons of the plurality of ribbons and urging the plurality of ribbons directly towards the processing unit.

13 Claims, 4 Drawing Sheets

UPPER FOLDER DRIVE ROLL ARRANGEMENT

FIELD OF THE INVENTION

The present invention relates to an apparatus for feeding multiple ribbons via driven rolls and more particularly, to an arrangement of drive rolls in the former section of a printing press.

BACKGROUND INFORMATION

The printing industry is continually increasing the speed at which printed copy can be generated. Printing, forming, folding, and cutting operations are often performed by a continuous operation machine, feeding in a web of blank paper from a roll and ending with a printed, cut, and folded finished product, referred to as a signature.

One step in the process of producing the printed product may, for example, involve feeding multiple ribbons, layered one on top of the other, over a former board and into nip rolls below the former board as shows in FIG. 1. The former board 30, as is known in the art, provides, for example, for folding the ribbons in half longitudinally. The folded ribbons typically pass from the former board 30 into a nip roller 37 located below the former board 30. The ribbons are initially traveling in a first plane coincident with the former board 30. When the ribbons fold in half longitudinally, they fold into a plane perpendicular to the plane of the former board. After being folded over the former board 30, the ribbons may, for example, be cut into individual signatures by a cutting cylinder 34, followed by a decelerating and shingling procedure. For example, the cutting cylinder may deposit the signatures into a tape drive system 21 that directs the signatures into a fan wheels 40, 41 which decelerate the signatures and places them onto conveyor belts 55, 56 in shingled formation.

The ribbons may be fed to the former board 30 as shown in FIG. 2, as in known in the art. Several ribbons 2, 3, 4 are, for example, driven by nip rolls 5, 6, 7, respectively. The ribbons 2, 3, 4 are gathered at a gathering roll 8 and then traverse to the roll at the top of the former (the "RTF roll") 10 before traversing the former board 30.

A problem may arise with such a configuration because, due to the layering of ribbons on the gathering roll 8 and RTF roll 10, the outermost ribbons traverse a larger radius than the inner ribbons. For example, successive ribbons 2 and 3 traverse a radius at least one ribbon thickness greater than the ribbon upon which it rests. As a result, each ribbon 2, 3, 4 has a different local velocity as it traverses the RTF roll 10, the local velocity of successive ribbons increasing as the radius increases. Therefore, each ribbon experiences a tension and strain different from the tension and strain in the other ribbons. The uneven tensions and strains between the ribbons may result in lateral weaving, web shifting, wrinkling, fold variation, and print-to-cut errors.

Several attempts at eliminating the problem of unequal tension in the ribbons have been attempted. For example, making the outermost ribbon on the gathering roll 8 be the innermost ribbon on the RTF roll 10 attempts to compensate for the tension imbalance. Any imbalance which occurs due to experiencing an unequal radius on the gathering roll 8 is intended to be counterbalanced by making each ribbon experience a proportionally counteracting radius on the RTF roll 10. However, this solution fails to adequately address the problem because, for example, the spans 11, 12, 13 of the ribbons 2, 3, 4 preceding the gathering roll 8 is typically different from the span 14 after the RTF roll 10. Thus, proper counterbalancing of tension does not occur. Additionally, the amount of slippage in the nips and the flow of nip roll material at the gathering roll 8 and at the RTF roll 10 are usually different. Therefore, the tension in the ribbons is not counterbalanced properly.

It is an object of the present invention to provide a device to alleviate problems associated with feeding multiple web ribbons to a roll of the former section of a printing press.

SUMMARY OF THE INVENTION

The present invention provides an apparatus for driving multiple ribbons which are joined together and also change direction by driving each of the multiple ribbons individually at the last roll position of the ribbon path and then joining the multiple ribbons together.

The upper folder drive roll arrangement according to the present invention eliminates the need for a gathering roll and eliminates the wrapping of multiple ribbons through a single driven nip point so that the compound radius problem of the prior art is avoided. Thus, the drive roll arrangement according to the present invention eliminates sources of transmission error that occur in prior art systems. Additionally, the present invention eliminates the need for a two-sided timing belt drive of prior art systems. The present invention also provides a system that is easier to web-up, has fewer parts and has reduced manufacturing costs compared with prior art systems.

DETAILED DESCRIPTION OF THE INVENTION

Figure 1:
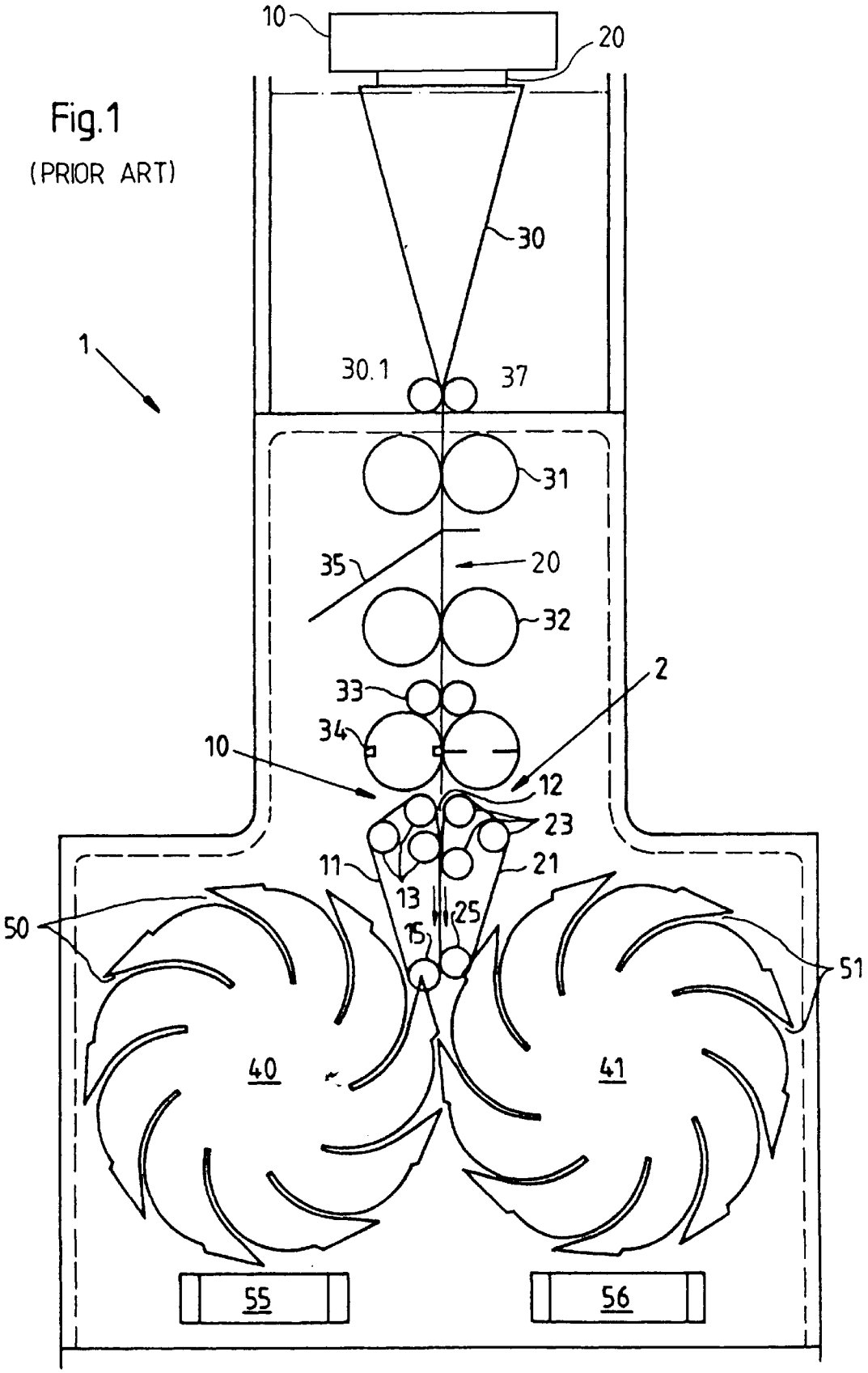
Fig.1 (PRIOR ART)
FIG. 1 is a front view of a prior art former section and nip roll section of a printing press.

In FIG. 1, a former section of a printing press is shown generally by reference numeral 1. In the prior art system illustrated, a web 20 travels from a printing press (not shown) to the former section of the press. The web 20 travels from pull rolls and a gathering roll (as shown more clearly in FIG. 2) to an RTF roll 10 located at the top of the former board 30. The web travels over the surface of the RTF roll 10 and over the former board 30.

The former board 30 is, for example, triangular in shape with the top dimension (e.g., dimension along the RTF roll 10) being approximately equal to the length of the RTF roll 10, sufficient to receive the full width of the web 20 flat on the top surface of the former board 30. Multiple webs or ribbons may feed simultaneously to the former board 30 arranged as continuous sheets one on top of the other. The former board 30 is arranged, for example, so that its surface slants downward from the RTF roll 10. The tip 30.1 of the triangular surface of the former board 30 points down and away from the RTF roll 10 at approximately the middle of the roller's length.

The web 20 is pulled down over the former board 30 by a driven set of nip rolls 37. The nip rolls 37 are, for example, a pair of rollers positioned parallel with one another with their axes roughly perpendicular to the axis of the RTF roll 10. The web 20 is folded in half longitudinally, facilitated by the triangular shape of the former board over which it travels, such that when the web 20 enters the nip rolls 37 it is in a folded configuration substantially perpendicular to the plane of the former board 30. The folded web 20 may be further processed, for example, through guiding rolls 31, 32, 33, cutting cylinders 34, a tape drive system 21, fan wheels 40, 41, the resultant signatures finally being deposited on conveyors 55, 56.

Figure 2:
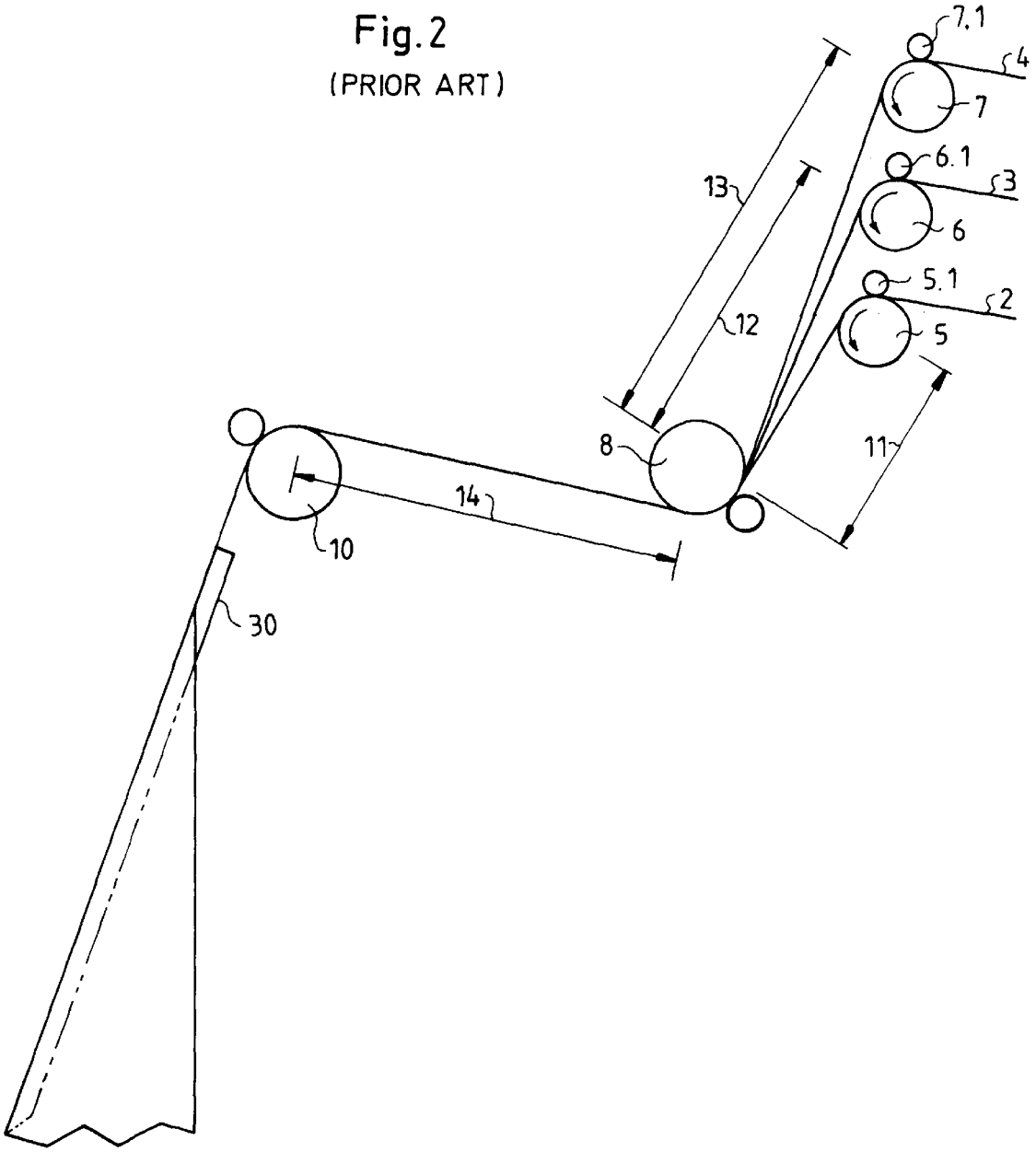
Fig. 2 (PRIOR ART)
FIG. 2 shows a side view of a portion of the former section of a printing press as is known in the art, including a gathering roll and an RTF roll.

FIG. 2 shows a side view of a portion of the former section of a printing press as is known in the prior art. Multiple ribbons 2, 3, 4 traverse pull rolls 5, 6, 7 and their respective nip rolls 5.1, 6.1, 7.1. The pull rolls 5, 6, and 7 may be driven rolls, as are known in the art. The ribbons 2, 3, 4 traverse from the pull rolls 5, 6, 7 to a gathering roll 8. The RTF roll 10, located at the top of the former board 30, receives the multiple ribbons 2, 3, 4 from the gathering roll 8. After traversing the RTF roll 10, the ribbons 2, 3, 4 pass to the former board 30 for processing as discussed above in reference to FIG. 1. As described earlier, a problem may arise with such a configuration because, due to the layering of ribbons on the gathering roll 8 and RTF roll 10, the outermost ribbons traverse a larger radius than the inner ribbons. For example, successive ribbons 2 and 3 traverse a radius at least one ribbon thickness greater than the ribbon upon which it rests. As a result, each ribbon 2, 3, 4 has a different local velocity as it traverses the RTF roll 10, the local velocity of successive ribbons increasing as the radius increases. Therefore, each ribbon experiences a tension and strain different from the tension and strain in the other ribbons. The uneven tensions and strains between the ribbons may result in lateral weaving, web shifting, wrinkling, fold variation, and print-to-cut errors.

Figure 3:
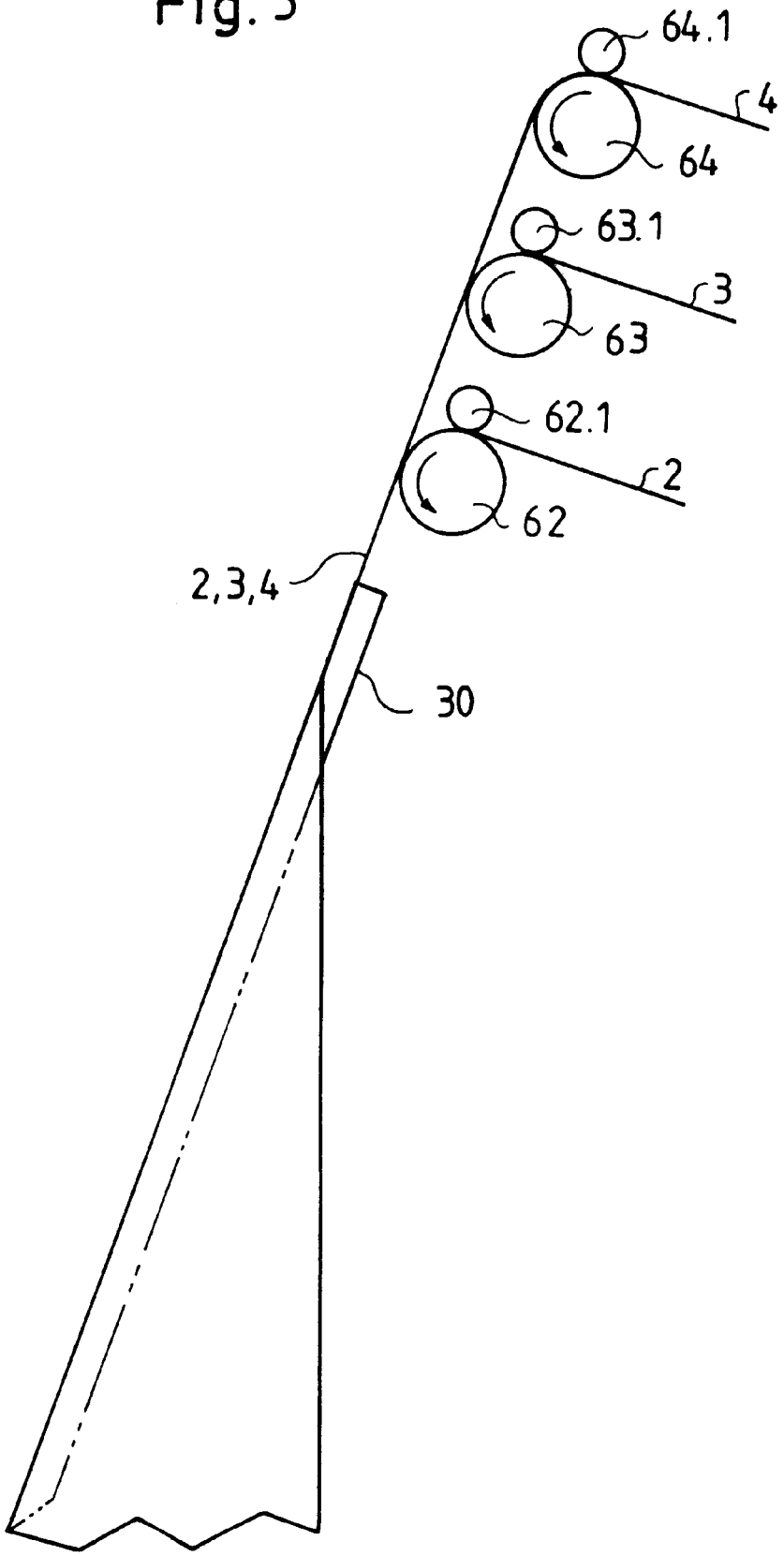
FIG. 3 shows a side view of a portion of the former section of a printing press according to a first exemplary embodiment of the present invention.

FIG. 3 shows a portion of the former section of a printing press according to an exemplary embodiment of the present invention wherein multiple ribbons 2, 3, 4 are delivered to the former board 30 by individual driven rolls 62, 63, 64 arranged above the former board 30. For example, ribbon 9 travels over roll 62 and then traverses to the former board 30. As shown in FIG. 3, no other ribbons pass over roll 62. Similarly, ribbon 3 travels individually over roll 63 and ribbon 4 travels individually over roll 64. The ribbons 2, 3, 4 then traverse directly to the former board 30 for further processing.

The rolls 62, 63, 64 are manufactured to ensure that each ribbon 2,3, 4 traverses substantially the same radius and therefore experiences substantially the same tension and strain. For example, tension and strain in a span of web material is created when the downstream nip has a higher surface velocity, or "gain", over the surface velocity of the preceding upstream nip. Two adjacent nip points in a web or ribbon define a span and control the stress and strain of the material in that span. Thus, if a plurality of ribbons have spans originating at a common nip or nips (e.g., before the web is slit into ribbons) with the same angular velocity and radius and terminating at nips that have the same "gain" over the preceding nip or nips, then the tension in each ribbon in its respective adjacent span will be very similar assuming that the nips are set sufficiently tight to ensure that slippage of the web material in the nip is negligible.

By removing the gathering roll from the prior art, thus also removing the wrapping of the layered ribbons 2, 3 and 4 around the gathering roll, the present invention avoids the varying radius experienced by each ribbon due to the multilayered ribbon which would otherwise create a non-uniform tension and strain. Each individual driven rolls 62, 63, 64 according to the present invention may form a nip with corresponding nip rolls 62.1, 63.1, 64.1, respectively, as illustrated in FIG. 3, but only a single ribbon passes through each driven nip. Thus, according to the present invention, each ribbon changes direction, e.g., wraps around a roll, via a driven cylinder without multiple ribbons simultaneously passing through the same driven nip point. The driven rolls 62, 63, 64 may be driven by belts coupled to electric motors, as is known in the art. The belt drive system for the driven rolls 62, 63, 64 may include a conventional two-sided timing belt system or, preferably a one-sided belt drive system.

Figure 4:
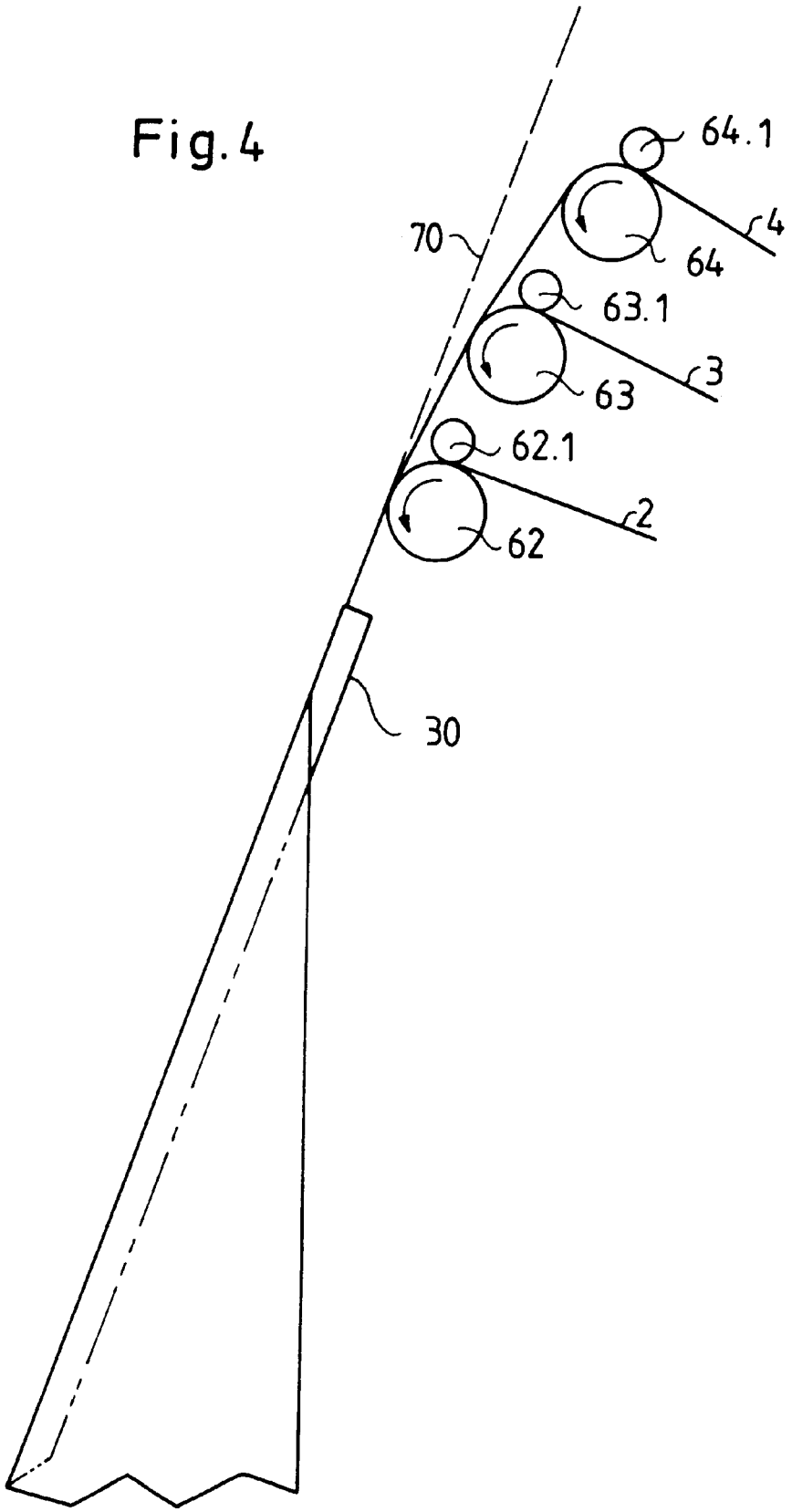
FIG. 4 shows a side view of a portion of the former section of a printing press according to a second exemplary embodiment of the present invention.

FIG. 4 shows an alternative exemplary embodiment of the present invention in which the individual driven rolls 62, 63, 64 are arranged with a slight offset from a tangent 70 to the former board 30. For example, roll 62 is relatively close to the tangent 70, roll 63 is slightly farther away from the tangent 70 than roll 62, and roll 64 is yet slightly farther from the tangent 70 than roll 63. Having the rolls 62, 63, 64 offset from the tangent 70 as in the arrangement of FIG. 4 causes each ribbon to wrap slightly around the roll below, although the ribbon does not pass through the driven nip of the lower roll. For example, ribbon 4 traverses from roll 64 down to roll 63 and slightly wraps around roll 63 because of roll 64's offset position. Ribbon 3 similarly traverses from roll 63 to roll 62 and slightly wraps around roll 62 because of roll 63's offset position from the tangent 70. Having the ribbons wrap slightly around the lower driven rolls helps reduce and/or drive out air entrapped between two adjacent ribbons. It is desirable to reduce the amount of air trapped between the ribbons because trapped air can cause wrinkling of the ribbons.

What is claimed is:

1. A device for feeding a plurality of ribbons to a processing unit, comprising:

a first driven roll receiving a first of the plurality of ribbons;

a second driven roll receiving a second of the plurality of ribbons; and wherein the first driven roll and the second driven roll are arranged adjacent to the processing unit, the first and second driven rolls individually driving respective ribbons of the plurality of ribbons and urging the respective ribbons directly towards the processing unit, the first and second ribbons meeting before the processing unit at the first driven roll.

2. The device according to claim 1, wherein the processing unit includes a former section of a printing press.

3. The device according to claim 2, wherein the former section includes a former board.

4. The device according to claim 1, wherein the first and second driven rolls are arranged directly above the processing unit.

5. A device for feeding a plurality of ribbons to a processing unit, comprising:

a first driven roll receiving a first of the plurality of ribbons;

a second driven roll receiving a second of the plurality of ribbons; and wherein the first driven roll and the second driven roll are arranged adjacent to the processing unit, the first and second driven rolls individually driving respective ribbons of the plurality of ribbons and urging the respective ribbons directly towards the processing unit, the first and second ribbons meeting before the processing unit, the first driven roll being disposed directly above the processing unit and the second driven roll being disposed above the first driven roll and offset from the first driven roll so that the respective ribbon received by the second driven roll wraps around a portion of the first driven roll.

6. A device for feeding a plurality of ribbons to a processing unit, comprising:

a first driven roll receiving a first of the plurality of ribbons;

a second driven roll receiving a second of the plurality of ribbons; and wherein the first driven roll and the second driven roll are arranged adjacent to the processing unit, the first and second driven rolls individually driving respective ribbons of the plurality of ribbons and urging the respective ribbons directly towards the processing unit, a surface of each of the first driven roll and the second driven roll being tangent to a plane of the plurality of ribbons being urged directly towards the processing unit.

7. The device according to claim 6, wherein the processing unit includes a former section of a printing press having a former board, a surface of each of the first driven roll and the second driven roll being tangent to a plane of the former board.

8. The device according to claim 6, wherein the first and second driven rolls are arranged directly above the processing unit.

9. The device according to claim 6, wherein the first driven roll is disposed directly above the former board and the second driven roll is disposed above the first driven roll and offset from the first driven roll so that the respective ribbon received by the second driven roll wraps around a portion of the first driven roll.

10. The device according to claim 6, further comprising at least one additional driven roll receiving an additional respective one of the plurality of ribbons, the at least one additional driven roll being arranged adjacent to at least one of the first driven roll and the second driven roll, the at least one additional driven roll urging the additional respective ribbon directly towards the processing unit.

11. The device according to claim 6, wherein each of the plurality of ribbons urged directly towards the processing unit is substantially parallel to an adjoining ribbon.

12. The device according to claim 6, wherein the plurality of ribbons beings urged directly towards the processing unit form a layered ribbon, the layered ribbon first entering a driven nip in the processing unit.

13. A device for feeding a plurality of ribbons to a former board comprising:

a first driven roll receiving a first of the plurality of ribbons;

a second driven roll receiving a second of the plurality of ribbons; and wherein the first driven roll and the second driven roll are arranged adjacent to the former board, the first and second driven rolls individually driving respective ribbons of the plurality of ribbons and urging the respective ribbons directly towards the former board, the first and second ribbons of the plurality of ribbons meeting before the former board at the first driven roll.

* * * * *